US006408533B2

(12) United States Patent
Sakamoto

(10) Patent No.: US 6,408,533 B2
(45) Date of Patent: Jun. 25, 2002

(54) HAIR DRYER

(75) Inventor: Toshihiro Sakamoto, Hong Kong (CN)

(73) Assignee: Matsushita Electric Works, Ltd., Kadoma (JP)

( * ) Notice: Subject to any disclaimer, the term of this patent is extended or adjusted under 35 U.S.C. 154(b) by 0 days.

(21) Appl. No.: 09/774,702

(22) Filed: Feb. 1, 2001

(30) Foreign Application Priority Data

Feb. 1, 2000 (JP) ..... 2000-023780

(51) Int. Cl.[7] ..... A45D 20/10
(52) U.S. Cl. ..... 34/97; 34/96; 392/385
(58) Field of Search ..... 34/96, 97, 98, 34/99, 100, 90; 392/385, 384

(56) References Cited

U.S. PATENT DOCUMENTS 4,003,388 A * 1/1977 Nopanen ..... 219/222
4,085,309 A * 4/1978 Godel ..... 392/384
4,214,149 A * 7/1980 Hoffmann ..... 392/384
5,727,331 A * 3/1998 Thaler ..... 34/97

* cited by examiner

*Primary Examiner*—Ira S. Lazarus
*Assistant Examiner*—Kathryn S. O'Malley
(74) *Attorney, Agent, or Firm*—Oblon, Spivak, McClelland, Maier & Neustadt, P.C.

(57) ABSTRACT

A hair dryer including a main body, a heater, a fan, a handle and a temperature control device. The main body has an air outlet and an outer surface. The heater is encased in the main body and configured to heat the air. The fan is provided in the main body and configured to blow air toward the heater. The handle is attached to the main body. The temperature control device is configured to control the heater to adjust a temperature of the air and has a temperature adjuster provided on the outer surface of the main body between the air outlet and the fan. The temperature adjuster is configured to rotate around the outer surface of the main body to adjust the temperature of the air.

16 Claims, 4 Drawing Sheets

HAIR DRYER

CROSS-REFERENCE TO RELATED APPLICATIONS

The present application claims priority under 35 U.S.C. §119 to Japanese Patent Application No. 2000-23780, filed Feb. 1, 2000, entitled "Hair Dryer". The contents of that application are incorporated herein by reference in their entirety.

BACKGROUND OF THE INVENTION

1. Field of the Invention

The present invention relates to a hair dryer.

2. Discussion of the Background

Conventionally, hair dryers have a pistol-like shape, i.e., a blowing part equipped with a fan and a heating device and a handle attached to this blowing part at a certain angle. These hair dryers usually have a two- or three-leveled switch to change the temperature of their blowing air, and such a switch is provided at their handles. Also, some hair dryers have a temperature controlling device designed to adjust the temperature of the blowing air. However, like the former hair dryers, such a temperature controlling device is provided also on the handles of those hair dryers. A user of the former hair dryers can select only two or three predetermined temperatures set by their manufacturers. A user of the latter hair dryers can adjust the temperature of the blowing air. However, because the temperature controlling device is on the handle, it would be difficult for her to adjust the temperature. For example, it is quite likely that she needs to free the temperature controlling device from her grip and either regrip or put the hair dryer into the other hand in order to make a temperature adjustment, particularly a fine adjustment.

SUMMARY OF THE INVENTION

According to one aspect of the present invention, a hair dryer includes a main body, a heater, a fan, a handle and a temperature control device. The main body has an air outlet and an outer surface. The heater is encased in the main body and configured to heat the air. The fan is provided in the main body and configured to blow air toward the heater. The handle is attached to the main body. The temperature control device is configured to control the heater to adjust a temperature of the air and has a temperature adjuster provided on the outer surface of the main body between the air outlet and the fan. The temperature adjuster is configured to rotate around the outer surface of the main body to adjust the temperature of the air.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
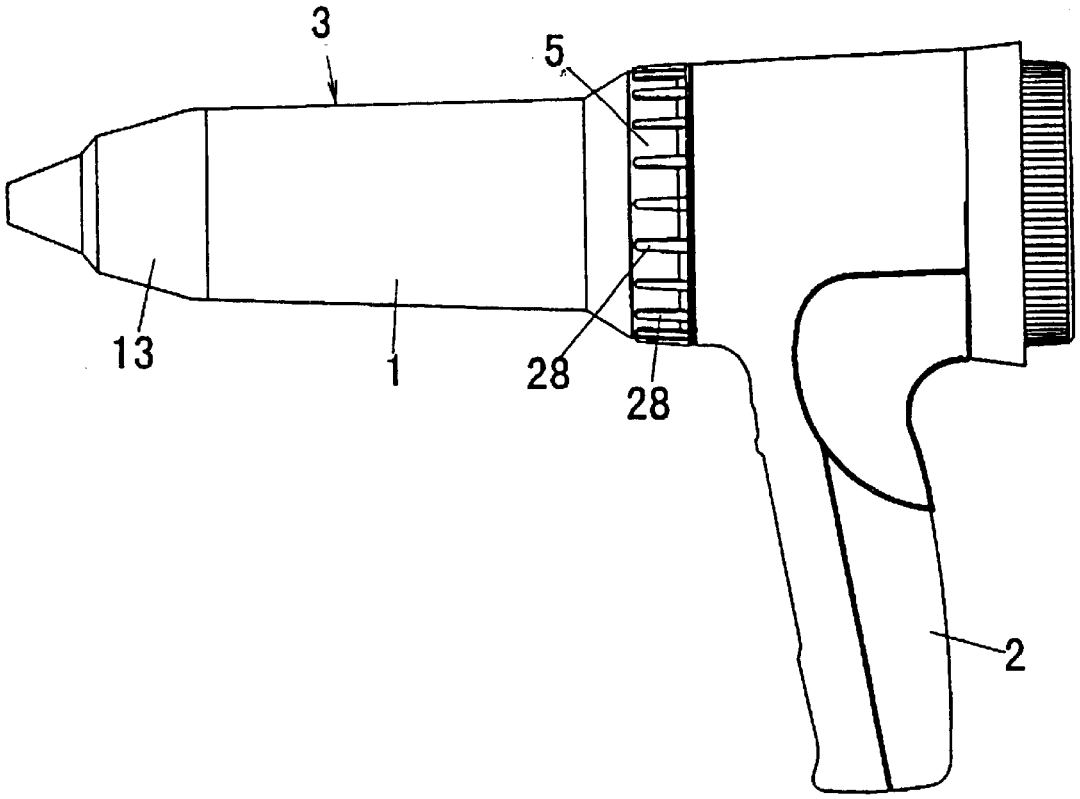
FIG. 1 is a side view of a hair dryer according to an embodiment of the present invention.

The preferred embodiments will now be described with reference to the accompanying drawings, wherein like reference numerals designate corresponding or identical elements throughout the various drawings.

Figure 2:
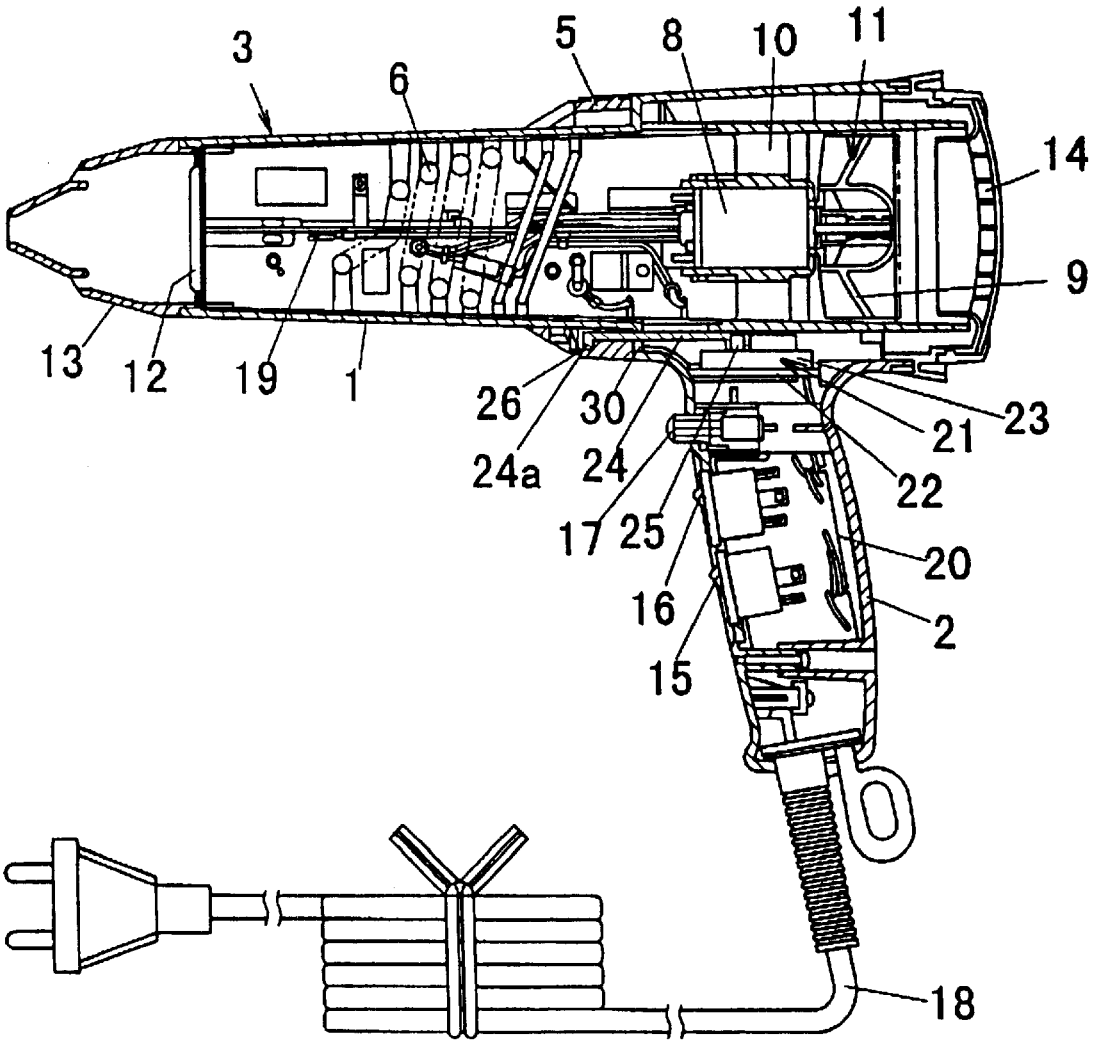
FIG. 2 is a cross-sectional view of the hair dryer shown in FIG. 1.

FIG. 1 is a side view of a hair dryer according to an embodiment of the present invention and FIG. 2 is a cross-sectional view of the hair dryer shown in FIG. 1.

Referring to FIG. 1, a hair dryer 3 has a main body 1 which is, for example, generally cylindrical, a handle 2 extending from the main body 1 at angle and a detachable nozzle 13 attached on the front end of the main body 1. The nozzle 13 may be fixed to the main body 1 or integrally formed as a part of the main body 1. A temperature adjuster 5 is provided on the main body 1. On the outer surface of the temperature adjuster 5, a number of elongated projections 28 are provided to ensure better gripping for a user.

Referring to FIG. 2, the main body 1 accommodates a heater 6 and a blowing device 11. The blowing device 11 includes a motor 8, a ventilation fan 9 and fixed vanes 10 for streamlining air flow. At the front end of the main body 1, an air outlet 12 is provided to send the air heated by the heater 6 in the main body 1 to outside, and the detachable nozzle 13 can converge the heated air before sending it to outside. At the rear end of the main body 1, an air intake 14 is provided to intake outside air into the main body 1. The temperature adjuster 5 is provided between the air outlet 12 and the ventilation fan 9. Accordingly, the temperature adjuster 5 and the heater 6 may be easily electrically connected.

In the handle 2, a main switch 15 for turning the hair dryer on and off, a flow rate selector 16 for choosing a certain flow rate from various flow rates, a cool blow switch 17 for blowing cool air are provided. Also, an electric cord 18 extends out from the bottom end of the handle 2.

Figure 3:
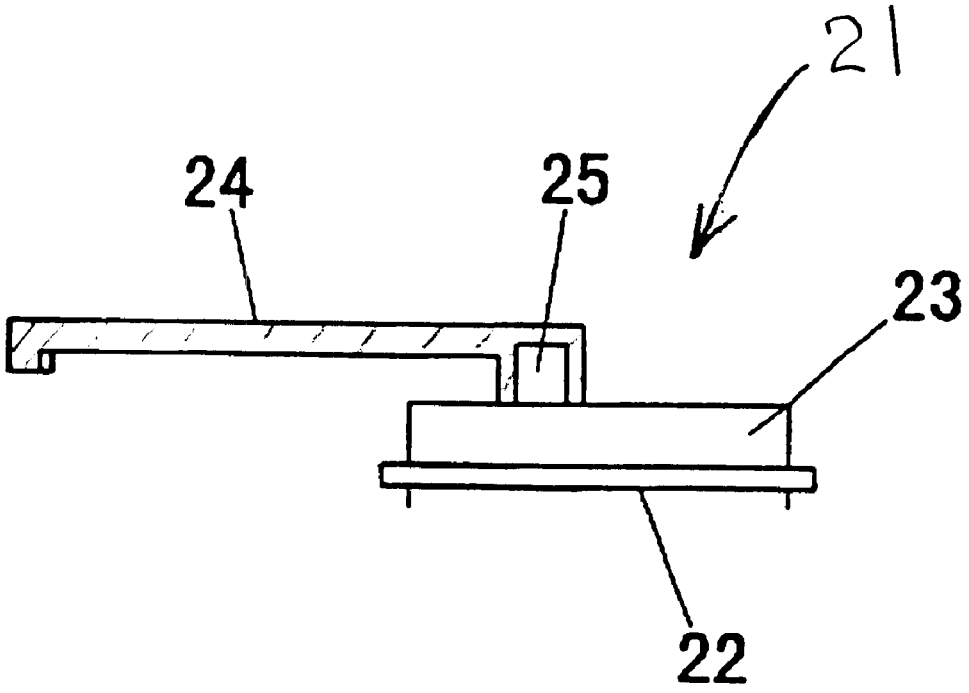
FIG. 3 is an enlarged side view of the adjustment device shown in FIG. 2.

Inside the main body 1, a temperature detector 19, for example, a thermistor, is provided near the heater 6 and detects the temperature of the blowing air. A control block 20 is provided inside the handle 2. The control block 20 is designed to receive a signal from the temperature detector 19 and control the electricity consumption of the heater 6. Further, the control block 20 is electronically connected, for example, by lead, to a variable unit 21. In FIG. 2, the variable unit 21 is positioned where the handle 2 is connected to the main body 1. The variable unit 21 sets an amount of the electricity consumption by the heater 6. FIG. 3 is a side view of the variable unit 21.

Referring to FIG. 3, the variable unit 21 includes a circuit board 22, an adjustment contact 23 provided on the circuit board 22 and a lever 24. The lever 24 has an adjustment controller 25 which is in contact with the adjustment contact 23. By making the adjustment controller 25 slide along the adjustment contact 23, the adjustment controller 25 alters the electricity consumption of the heater 6. Consequently, the temperature of the air heated by the heater 6 is adjusted. In addition, by operating the adjustment controller 25 along the adjustment contact 23 through the lever 24, the variable unit 21 effectuates gradually progressive and regressive temperature control. Hence, the temperature of the air heated by the heater 6 can be finely adjusted.

Figure 4A:
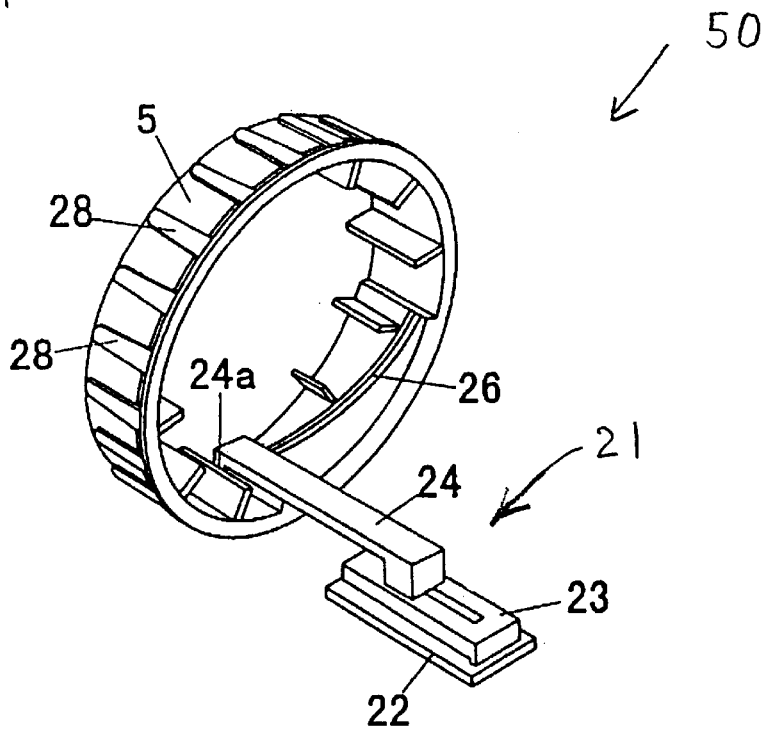
FIG. 4A is a perspective view of the temperature controller and the adjustment device shown in FIGS. 1–3 in one state.
Figure 4B:
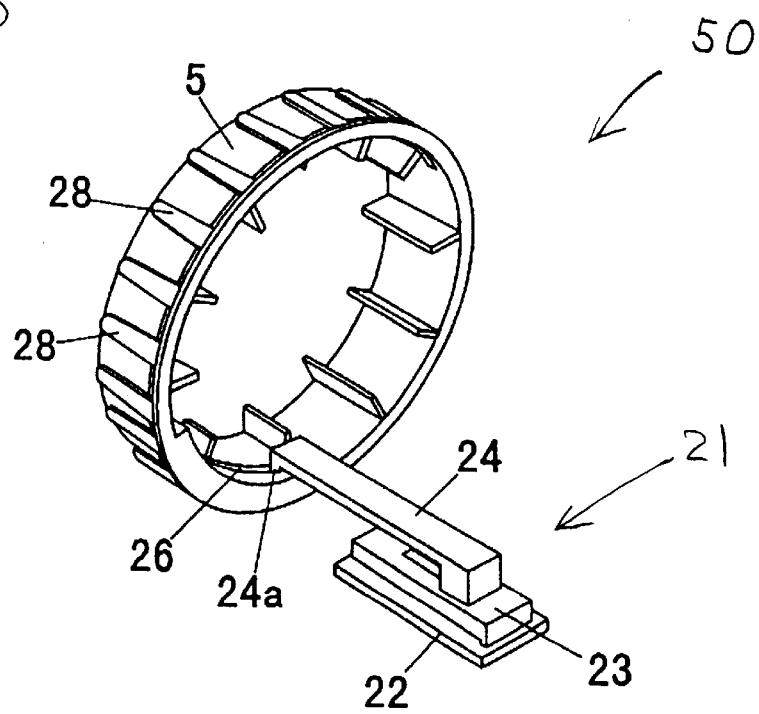
FIG. 4B is a perspective view of the temperature controller and the adjustment device shown in FIG. 4A in a different state.

FIGS. 4A and 4B are perspective views of a temperature control device 50 including the temperature adjuster 5 and the variable unit 21 shown in FIGS. 1–3 in two different states.

Referring to FIGS. 1, 4A and 4B, the temperature adjuster 5 which has a ring-like shape is attached around the outer circumferential surface of the main body 1 and designed to rotate around the axis of the main body 1. On the inner surface of the temperature adjuster 5, a helical groove 26 winding with respect to the axis of the main body 1 is provided. A hook portion 24*a* on a tip of the lever 24 is slidably fitted in the helical groove 26. Thus, when the temperature adjuster 5 rotates around the axis of the main body 1, the hook portion 24*a* of the lever 24 slides along the helical groove 26 and the lever 24 slides in a direction substantially parallel to the axis of the main body 1. As a result, the adjustment controller 25 (see FIG. 3) slides along the adjustment contact 23 and alters the electricity consumption of the heater 6. The temperature of the air heated by the heater 6 is therefore adjusted.

In the embodiment described above, the shift ratio of the adjustment controller 25 along the adjustment contact 23 to the hook portion 24*a* along the helical groove 26 may be 1 to approximately 3. For example, the adjustment controller 25 slides 10 mm along the adjustment contact 23 as the hook portion 24*a* slides approximately 30 mm along the helical groove 26. By setting a shift ratio as such, the adjustment controller 25 and the adjustment contact 23 make a sufficiently fine alteration of the electricity consumption by the heater 6 to permit a fine temperature adjustment of the air heated by the heater 6. However, by making the helical groove 26 longer, it is possible to make the temperature adjustment finer.

As described above, a number of the elongated projections 28 are provided on the outer surface of the temperature adjuster 5. These elongated projections 28 provide better gripping and easier adjustment for a user. For instance, the elongated projections 28 may be provided at an equal interval and each of the elongated projections 28 may have elongation substantially parallel to the axis of the main body 1. Hence, she can easily get hold of the temperature controller, turn it and adjust the temperature of the air without losing her grip.

According to the embodiment of the present invention described above, the temperature control device 50 is designed to control the heater 6 to adjust a temperature of the air and has the temperature adjuster 5 provided on the outer surface of the main body 1. A user can therefore adjust the temperature of the blowing air easily with one hand while holding on to the handle with the other hand. As a result, the user can continue to dry or style her hairs without awkwardly struggling or disrupting her drying or styling effort for the temperature adjustment. For example, according to the embodiment of the present invention described above, the temperature adjuster 5 may have a ring-like shape and rotate with respect to the axis of the main body 1. Thus, the user can simply use her finger to operate the temperature control device 50 from any part of the temperature adjuster 5 and also easily reach and operate the temperature adjuster 5 from any positions or directions when she moves the hair dryer around her head.

In the embodiment, although the helical groove 26 is provided to guide the hook portion 24*a*, any guide may be provided to guide the hook portion 24*a*. For example, a step portion to guide the hook portion 24*a* may be provided.

Obviously, numerous modifications and variations of the present invention are possible in light of the above teachings. It is therefore to be understood that within the scope of the appended claims, the invention may be practiced otherwise than as specifically described herein.

What is claimed is: WHAT IS CLAIMED AS NEW AND DESIRED TO BE SECURED BY LETTERS PATENT OF THE UNITED STATES IS:

1. A hair dryer comprising:

a main body having an air outlet and an outer surface;

a heater encased in said main body and configured to heat the air;

a fan provided in said main body and configured to blow air toward the heater;

a handle attached to said main body; and a temperature control device configured to control said heater to adjust a temperature of the air and having a temperature adjuster provided on said outer surface of said main body between the air outlet and the fan, said temperature adjuster being configured to rotate around said outer surface of said main body to adjust the temperature of the air.

2. The hair dryer according to claim 1, wherein said main body has a substantially cylindrical shape.

3. The hair dryer according to claim 1, wherein:

said temperature control device comprises a variable unit configured to vary electricity supply to said heater; and said variable unit is coupled to said temperature adjuster.

4. The hair dryer according to claim 1, wherein said temperature adjuster has a ring shape and is provided around said outer surface of said main body.

5. The hair dryer according to claim 3, wherein said variable unit comprises an adjustment controller and is configured to vary the electricity supply to said heater by moving said adjustment controller in said variable unit.

6. The hair dryer according to claim 5, wherein said adjustment controller is configured to make a liner movement in said variable unit when said temperature adjuster is rotated.

7. The hair dryer according to claim 5, wherein said adjustment controller moves in said variable unit for a shorter distance than said temperature adjuster when said temperature adjuster is rotated.

8. The hair dryer according to claim 7, wherein said adjustment controller moves in said variable unit for approximately one third of a distance traveled by said temperature adjuster when said temperature adjuster is rotated.

9. The hair dryer according to claim 1, wherein:

said temperature control device comprises a variable unit configured to vary electricity supply to said heater;

said variable unit has a lever having a hook portion and an adjustment controller configured to change the electricity supply to said heater by moving in said variable unit; and said lever is slidably coupled to said temperature adjuster.

10. The hair dryer according to claim 9, wherein:

said temperature adjuster has an inner circumference; and said inner circumference of said temperature adjuster has a guide slidably accommodating said hook portion of said lever.

11. The hair dryer according to claim 10, wherein the guide is a helical groove.

12. The hair dryer according to claim 10, wherein said hook portion travels a longer distance along said guide than said adjustment controller in said variable unit when said temperature adjuster is rotated.

13. The hair dryer according to claim 1, wherein said temperature adjuster has an outer circumference and a plurality of gripping elements provided on said outer circumference.

14. The hair dryer according to claim 13, wherein said plurality of gripping elements on said outer circumference is provided at an equal interval.

15. The hair dryer according to claim 13, wherein said plurality of gripping elements on said outer circumference comprises a plurality of projections provided on said outer circumference.

16. The hair dryer according to claim 15, wherein said plurality of projections on said outer circumference each is a projection elongated parallel to a longitudinal axis of said main body.

* * * * *